United States Patent [19]

Olson et al.

[11] Patent Number: 4,475,283

[45] Date of Patent: Oct. 9, 1984

[54] COMBINATION FUSE PULLER AND FUSE CONDITION INDICATOR

[75] Inventors: Harry W. Olson, Woodridge; John M. Borzoni, Des Plaines, both of Ill.

[73] Assignee: Littelfuse, Inc., Des Plaines, Ill.

[21] Appl. No.: 364,417

[22] Filed: Apr. 1, 1982

[51] Int. Cl.[3] ..... B25B 27/14; H01R 43/00

[52] U.S. Cl. ..... 29/720; 29/278; 29/764; 81/3.8

[58] Field of Search ..... 29/764, 278, 720; 81/3.8; 7/107, 170

[56] References Cited

U.S. PATENT DOCUMENTS

| | | | |
|---|---|---|---|
| 4,033,032 | 7/1977 | Romania et al. | 29/764 |
| 4,141,138 | 2/1979 | Quick | 29/764 X |
| 4,314,383 | 2/1982 | Epstein | 81/3.8 X |

*Primary Examiner*—Carl E. Hall

*Attorney, Agent, or Firm*—Russell E. Hattis

[57] ABSTRACT

A fuse puller device comprises a pair of spaced confronting body portions respectively having confronting lower fuse-gripping jaw sections each formed by a wall terminating in a horizontally inwardly facing lip-forming projection adapted to underlie the overhung portion of a fuse housing head portion, the jaw sections respectively joining confronting finger-squeezable sections which effect a pivoting separation of the jaw sections when squeezed between the user's thumb and forefinger. The lip-forming projections have recesses which engage ribs on the fuse housing to center the fuse puller device. A fuse condition indicator unit mounted on the inner face of one of the jaw section walls has a pair of indicator terminals adapted to engage fuse continuity test terminals exposed on the head portion of the fuse housing to test whether or not there is continuity between the test terminals when the fuse puller device is applied over the head portion of the fuse.

20 Claims, 16 Drawing Figures

COMBINATION FUSE PULLER AND FUSE CONDITION INDICATOR

BACKGROUND OF INVENTION

This invention relates to fuse pullers and, in particular, to a device for removal of a blade-type fuse like that disclosed in U.S. Pat. No. 3,909,767. This fuse, developed in the 1970's and now used in all U.S. made automobiles, has a head portion overhanging the opposite sides of a lower housing portion from which depends blade terminals which are extendable into pressure clip terminals of a mounting block having relatively small recesses for receiving the fuses protecting various electrical circuits of the automobiles involved.

While the overhanging head portion of the fuse housings can be grasped by the user's finger to withdraw the fuses from the recesses of the fuse block, it has been thought more convenient to use fuse pulling devices for this purpose. Two types of fuse pulling devices have heretofore been utilized for this purpose. One form has a scissors-like design including a pair of initially widely spaced apart jaw sections which fit over the head portion of the fuse. The user squeezes finger-squeezable end portions of the device to cause the jaw sections thereof to grip the lower portion of the housing immediately below the head portion thereof, so that withdrawing the fuse puller while maintaining pressure on the finger-squeezable portions the fuse can be readily removed from the mounting block. This device, because of its scissor-like construction, could not be readily molded as a single piece and so the cost of manufacturing such a fuse puller was more substantial than desired. Also, the construction of a scissor-type fuse puller makes it difficult if not practically impossible to add to the fuse puller an indicator unit which could be used to indicate the continuity or discontinuity of the fuse involved, as in the case of some prior art fuse puller devices for cylindrical fuses which were also designed to act as fuse condition indicators.

Another type of fuse puller device heretofore developed has a clothes-pin like construction; that is, it includes a pair of confronting jaw sections which are initially spaced apart relatively closely, so that they can grip the lower portion of the fuse housing below the overhanging head portion thereof in its normal condition. This fuse puller device has confronting finger squeezable sections which when squeezed separate the jaw sections thereof to permit it to be placed over the head portion of the fuse housing or to remove it from the fuse housing after the fuse had been removed from the mounting block. This fuse puller device is a one piece synthetic molded device, which therefore could be made at a much lower manufacturing cost than the scissor-type fuse puller device described. However, this type of device suffers from the disadvantage heretofore thought inherent in such a device in that it was thought necessary to design it to require a substantial squeezing force to open the jaw section because, otherwise, the grasping force of the user in the process of pulling the device away from the mounting block could readily accidentially open the jaw sections of the fuse puller device so that the fuse would be dropped in the process of removing the same from a mounting block. Another disadvantage of this fuse puller device is that it was not readily adaptable to be combined with an indicator unit for indicating fuse continuity.

As previously indicated, there has been heretofore developed fuse puller and fuse condition indicating devices useable only with a conventional cylindrical-type fuse which has metal terminals at the ends of a cylindrical glass envelope. One of these devices has clamping jaws which engage the terminals of the fuse and also act as terminals for an indicating circuit including an indicating lamp, so that when the fuse puller device is applied to the terminals of the fuse if the fuse has continuity shown by the de-energization of the indicating lamp shunting the fuse, the fuse is left in place. However, if upon application of the combination fuse puller and indicating device the lamp is energized indicating no fuse continuity, the user withdraws the defective fuse from the fuse mounting block by pulling the fuse gripping puller device away from the fuse mounting block. In such a device, there is no problem of centering the fuse puller device so that it makes proper electrical contact with the fuse terminals when it is applied to the fuse, since the gripping jaws thereof also act as the terminals for the indicator. To our knowledge, there has not been heretofore proposed a combination fuse puller and fuse condition indicating device useable with the blade-type fuse described, where fuse continuity test terminals are commonly exposed on the outer face of the head portion of the fuse, so that the gripping jaws of the fuse puller device which are to underlie this head portion cannot also act as terminals for an indicating lamp circuit.

It is, accordingly, one of the objects of the present invention to provide a fuse puller device useable with the blade-type fuse described and of a clothes pin-type construction so that it can be more readily made as a one piece synthetic plastic molded product, but wherein it does not have the disadvantages of the previously described clothes pin-type fuse puller device, namely the difficulty of opening the fuse puller and/or incorporating a fuse condition indicator unit in connection therewith.

Another object of the invention is to provide a fuse puller device for the blade-type fuse described, whether it be of the clothes pin-type or the scissors-type, which is adapted to be used with a fuse condition indicator unit for indicating continuity of the fuse and which can be readily centered on the fuse so that the indicator unit terminals which are separate from the jaws thereof will be aligned with the fuse continuity test terminals on the outer face of the fuse housing.

A still further object of the invention is to provide a fuse puller device of the clothes pin-type which is designed in such a fashion that the finger squeezable portions thereof used to open the fuse puller can be opened with a much smaller force than that required to open the prior art clothes pin-type fuse puller device described, but without the danger that the device would be opened in the process of pulling the fuse puller device in a direction to remove a fuse from a mounting block recess.

SUMMARY OF FEATURES OF INVENTION

While some of the features of the present invention are applicable to either a scissor-type fuse pulling or a clothes pin-type device, in the preferred form of the invention the fuse puller device is of the clothes pin-like construction and so accordingly has a pair of spaced confronting body portions respectively having lower fuse-gripping jaw sections terminating in horizontally inwardly facing lip-forming projections adapted to underlie said overhanging head portion of the fuse housing, so that an upward pulling force applied to the fuse puller device will remove the fuse from the pressure clip terminals of the mounting block recess involved. The jaw sections are normally spaced apart a sufficient distance to enable the lip-forming projections thereof to underlie the overhanging head portion of the fuse housing and preferably to grip the sides of the fuse housing. The lower ends of the jaw sections are shaped to be separated by the mere act of pushing the fuse puller device down upon the head portion of the fuse housing. The fuse puller device preferably has downwardly facing shoulders which contact the top of the fuse housing when the lip-forming projections pass slightly below the head portion of the fuse.

The upper ends of the jaw sections terminate in upper confronting finger squeezable sections which are squeezed when it is desired to separate the lower ends of the jaw sections or remove the same from a fuse pulled from the mounting block involved. In accordance with one of the features of the invention, the confronting body portions form part of a single piece synthetic plastic molded product, the confronting body portions being interconnected by downwardly bowing, semi-rigid, deformable arcuate straps extending between the vertical side margins of the body portions of the fuse puller, preferably immediately below points where the upper finger squeezable sections of the fuse puller device overhang the vertical side margins of the jaw sections thereof. The downwardly bowed arcuate straps are contracted to bring the ends thereof closer together by squeezing the upper sections of the device. The arcuate straps form pivot hinges which permit the jaw sections to be adequately separated with a modest squeezing force applied to the finger squeezable upper sections of the fuse puller device.

In accordance with another feature of the invention, which does not necessarily require the pivot-forming bowed arcuate straps just described, the length of the fuse puller device is designed so that it is of the order of magnitude of the length of the first segment of the thumb or forefinger of an average adult hand, as, for example, a length of about one inch. Also, in such case, by spacing the pivot axis of the device from the end of the jaw sections of the fuse pulling device no less than about 50% and no greater than about 70%, preferably one half the distance between these extremes, a not insignificant but modest squeezing force applied to the finger squeezable upper sections of the fuse puller device will readily separate the jaw sections thereof. Also, to avoid the user's gripping of the fuse puller device during fuse removal in a manner which would tend to separate the jaw sections, the opposite outer faces of the jaw sections below the pivot axis of the device are provided with finger-receiving indentations which communicate to the user that normally he should grip the jaw sections of the fuse puller below this pivot axis so that the user would then apply a force to the jaw sections tending to keep them closed. Also, in the most preferred form of the invention, the upper squeezable portions of the fuse puller device are provided with horizontally extending projections or ribs which act as grippable pivot points for the user's thumb and forefinger, so that when the user desires to open the jaw sections of the device he merely pivots his thumb and forefinger against these projections or ribs located above the pivot axis of the device, which spaces the finger ends apart, and removes them from the aforesaid recesses, where a modest squeezing force applied by these fingers will readily separate the jaw sections of the fuse puller device.

In accordance with a still further feature of the invention, a fuse puller device having one or more of the features just described is preferably designed to receive, when desired, a separate lamp indicator fuse continuity unit, and so that it can be readily centered with respect to the head portion of the blade-type fuse so that terminals of the indicator unit will automatically engage the fuse continuity test terminals on the fuse housing when the fuse puller device is applied over the head portion of the fuse housing. The lamp indicator unit has a pair of contact terminals projecting downwardly therefrom so that when the fuse pulling device is applied approximately in the desired center position over the head portion of the fuse housing, it will be automatically guided into a position where the lip-forming projections at the bottom ends of the jaw sections snap into place around projections or ribs commonly found in the lower section of the blade-type fuse housing presently being marketed, immediately below the overhanging head portion thereof. To this end, in accordance with another feature of the invention, each of the jaw sections of the fuse puller device is formed by a wall having a single lip-forming edge extending the full width of the bottom portion of the jaw section. Centered along this lip-forming edge is a recess with curved or inclined outer ends adapted to guide a slightly off-centered fuse puller device into a position where the lip edge recesses snap into a centered position around the fuse housing ribs referred to. (As previously indicated, the fuse gripping ends of the jaw sections are preferably normally spaced apart a distance so that they grip the lower portion of the fuse housing without any external force applied to the jaw sections of the fuse puller device).

Some of the other unique aspects of the invention deal with the construction of the lamp indicator unit and its relationship to indicator-unit receiving cavity between the confronting body portions of the fuse puller device.

The above and other objects, advantages and features of the invention will become apparent upon making reference to the specification to follow, the claims and drawings.

DESCRIPTION OF EXEMPLARY FORM OF INVENTION SHOWN IN DRAWINGS

Figure 1:
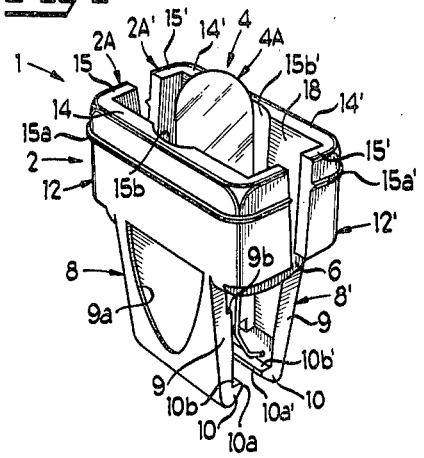
FIG. 1 is a perspective view of the fuse puller device of the invention, with the fuse condition indicator unit secured in place within the indicator unit-receiving slideway of the fuse puller device.
Figure 4:
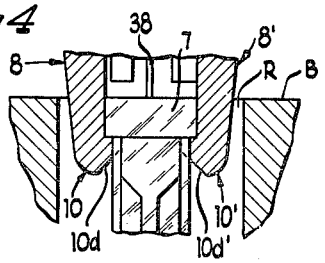
FIG. 4 is a fragmentary vertical sectional view through the combination fuse puller device and indicator unit assembly shown in FIG. 3, illustrating the small clearances generally found between the fuse of FIG. 3 and the recess in a mounting block conventionally used to receive such fuses.

Referring now more particularly to FIG. 1, shown therein is an assembly of a preferred form 1 of an assembly of a fuse puller device 2 and a lamp indicator unit 4 of the invention. If desired, the fuse puller device 2 could be manufactured without the assembly of the lamp indicator unit 4 therewith, such as the case where the lamp indicator unit 4 is not designed to relate to the particular fuse housing involved or for some other reason the purchaser does not desire the presence of a fuse continuity testing unit. The fuse puller device 2 will first be described in detail without any detailed reference to the lamp indicator unit 4. Suffice it say for the present, the lamp indicator unit 4 comprises a mounting base 4B which can be slide-fitted into a recess in one of the jaw sections of the fuse puller device 2. An indicator lamp 4A is designed to snap-fit into the mounting base 4B in a manner to be described. The lamp indicator unit 4 further includes a pair of spring-wire terminals 4C—4C' which engage exposed terminals on the lamp unit 4A to be described and which have end portions which engage with fuse continuity test terminals T—T (FIG. 7) exposed on the outer face of the fuse 3 to be removed by the fuse puller device 2. When the fuse puller device and lamp indicator unit assembly 1 is properly positioned over the fuse, the ends of the fuse wire terminals 4C—4C' will make contact with the fuse continuity terminals T—T of the fuse and, if the lamp 4A is energized, evidencing that the fuse has been blown or is otherwise open, the fuse puller device 2 is pulled to remove the fuse from the mounting block B involved (FIG. 4). If the indicator lamp 4A is de-energized, indicating a fuse with continuity which short circuits the lamp, then the fuse puller device 2 can be removed from the fuse involved or left on the fuse which becomes a storing means for the fuse puller device.

Figure 3:
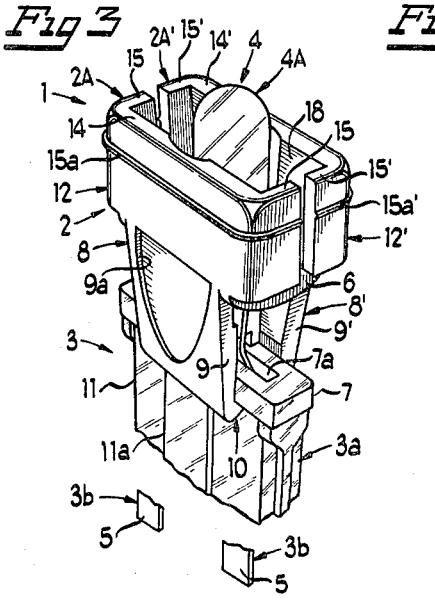
FIG. 3 is a perspective view of the fuse puller device shown in FIG. 1 applied over and beneath the head portion of a blade-type fuse commonly used in U.S. made automobiles.

As previously indicated, a combination fuse puller device and indicator lamp unit assembly has not been heretofore proposed or constructed to our knowledge for a blade-type fuse of the type shown in the drawings. This type of fuse, as illustrated in FIG. 3, comprises a housing 3*a* made of synthetic plastic material and an all-metal plug-in fuse element 3*b* enclosed by the housing except for blade portions 5—5 projecting from the bottom of the housing to form terminals fittable into pressure clip terminals (not shown) generally at the bottom of a recess R in the bottom of the mounting block B. The fuse housing 3*a* has a head portion 7 overhanging opposite sides of the lower portion 11 of the fuse housing, which lower portion has on each side a projecting rib 11*a* or the like which will form a centering guide for the fuse puller device 2 in a manner to be described, so that the fuse wire terminals 4C—4C' of the indicator unit can be properly positioned to engage the fuse continuity terminals T—T exposed on the outer face of the head portion 7 of the housing 3*a*.

Figure 8:
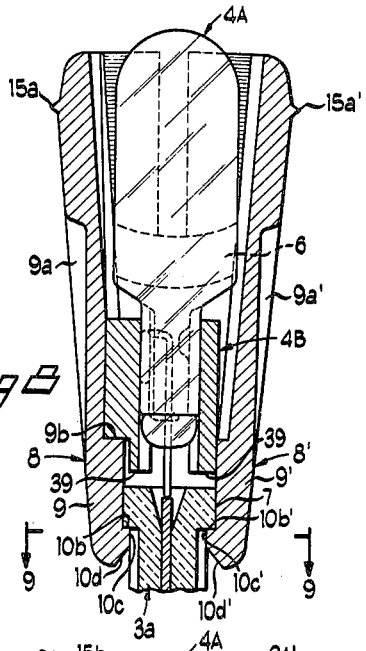
FIG. 8 is a transverse sectional view through the assembly shown in FIG. 6, taken along section lines 8—8 therein.
Figure 9:
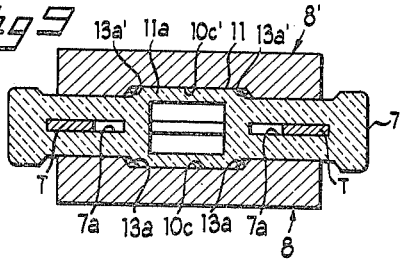
FIG. 9 is a horizontal sectional view through the assembly shown in FIG. 8, taken along section 9—9 therein.

The fuse puller device 2 is most advantageously made as a one piece synthetic plastic molded unit comprising confronting body portions 2A—2A' joined by downwardly bowed, arcuate pivot-forming semi-rigid deformable straps 6—6. The body portions 2A—2A' form lower jaw sections 8—8' merging at the upper ends thereof in upper finger squeezable sections 12—12'. The jaw sections 8—8' are formed by respective slightly downwardly inclining walls 9—9' which terminate in lip-forming projections 10—10' confronting one another along lip edges 10*a*—10*a*'. The lip-forming projections 10—10' define upwardly facing shoulders 10*b*—10*b*' adapted to underlie the bottomly facing surfaces of the head portion 7 of the fuse housing 3*a*, as best shown in FIG. 8. Centered along the lip edges 10*a*—10*a*' are recesses 10*c*—10*c*' (see FIGS. 9 and 10) which are adapted to come over and envelope the ribs 11*a*—11*a* (referred to in the claims as "discontinuity-forming means") formed at the opposite sides of the lower portion 11 of the fuse housing 3*a*. The recesses have inclined cam-forming ends 13*a*—13*a* and 13*a*'—13*a*' to aid in centering the fuse puller device over the fuse housing. The jaw sections are normally spaced apart a distance such that the lip edges 10*a*—10*a*' will grip the fuse housing sides when the fuse puller device is properly centered thereon. The natural resiliency of the synthetic plastic material out of which the fuse puller device 2 is made, will therefore, cause a centering force on the jaw sections which, if the fuse puller device is applied in a slightly offcentered position, enables the inclined ends of the lip edge recesses 10*c*—10*c*' to cam the device into a centered position on the fuse housing.

Figure 15:
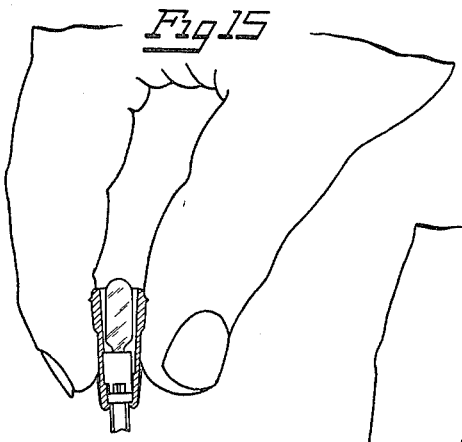
FIGS. 15 and 16 respectively illustrate the two different gripping positions of the user's thumb and forefinger when the fuse puller device of FIGS. 1—14 respectively is gripped for opening the fuse puller device, on the one hand, and for removing a fuse from the mounting block, on the other hand.
Figure 16:
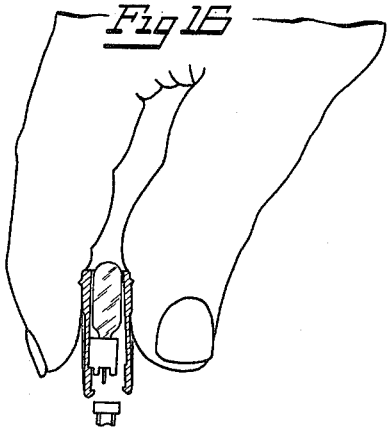

The jaw section-forming walls 9—9' have finger-receiving recesses 9*a*—9*a*' which are sized to receive the fleshy part of the outer end portions of the first segment of the thumb and forefinger of an averaged size adult hand, the recesses informing the user that the user should position his fingers in these recesses to grip the fuse puller device when the fuse puller device is to be maintained in a position where it is to tightly grasp the fuse as the user withdraws the fuse from the mounting block recess R (see FIG. 15). To open the fuse puller device, the user pivots the thumb and forefinger grasping the same as shown in FIG. 15 to separate the same, to bring the fleshy inner end of the first finger segments involved against horizontal projecting ribs 15*a*—15*a*′ on the finger-squeezable section, as shown in FIG. 16, where finger pressure now separates the jaw sections 8—8′.

The finger squeezable sections 12—12′ are defined by walls 14—14′ which terminate in inwardly extending end flanges 15—15 and 15′—15′ which overhang the vertical side margins of the jaw section walls 9—9 just beyond the pivot-forming straps 6—6. The walls 14—14′ and their flanges define a lamp indicator unit-receiving cavity 18.

Figure 5:
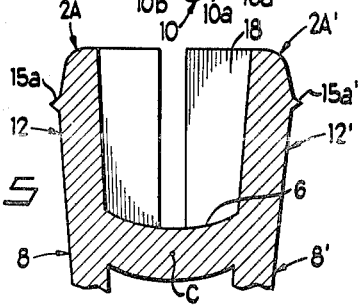
FIG. 5 is a fragmentary vertical sectional view through the fuse puller device, with the lamp indicator unit removed therefrom, as seen along a section plane defined by the section lines 5—5 in FIG. 2, the figure illustrating the shape of the pivot-forming straps which enable the jaw sections of the fuse puller device to pivot into an open position when the finger squeezable upper sections thereof are squeezed.
Figure 6:
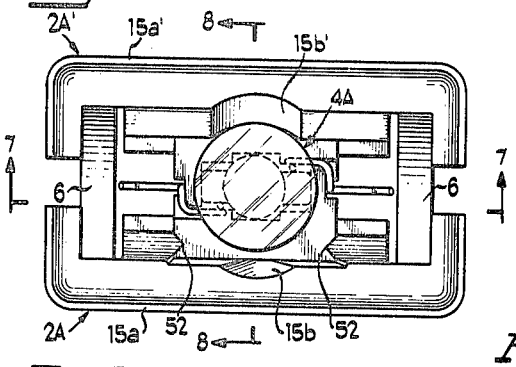
FIG. 6 is a top plan view of the combination fuse puller device and indicator unit assembly in the fuse gripping condition thereof shown in FIG. 3.

The jaw sections 8—8′ are pivotable about a pivot axis defined by the center points C (FIG. 5) of the arcuate straps 6—6 which bow toward the lip-formal projection 10—10′ at the end of the jaw sections 8—8′. A squeezing force applied to the squeezable sections 12—12′ brings the ends of the straps 6—6 closer together, to effectively cause a pivoting action about strap center points C which separate the lip-forming projections 10—10′ at the ends of the jaw section 8—8′. As previously indicated, it was found that when the length of the end (first) segment of the thumb and forefinger of the average adult-sized hand, which is approximately 1 inch, the center point C of the straps 6—6 are preferably not less than about 0.5 inches or greater than about 0.7 inches from the lip edges 10*a*—10*a*′. In the case of the most preferred construction shown in the drawings, which is a fairly accurate to scale drawing of the expected commercial form of the invention, the pivots point C are about 0.6 inches from the lip edges 10*a*—10*a*′.

As previously indicated, it is generally preferred that the lamp indicator unit 4 be assembled with the fuse holder device 2. As perhaps best shown in FIGS. 2 and 11, the mounting base 4B for the lamp 4A has a block-like configuration including opposite vertical side faces 29*a*—29*a*, a flat top fuse 29*b* and vertical end faces 29*c*—29*c*′. Extending downwardly through the mounting base from the top face 29*b* is a lamp unit-receiving passageway 28 having a relatively large central section 28*a* into which fits the central cylindrical depending stem 27 of the lamp envelope 20. The lamp envelope 20 has a bottom portion including the stem 27 and thinner side legs 22—22 along which are exposed conductive wire terminals 26—26. The legs 22—22 have locking grooves 24—24 adapted to make locking engagement with laterally projecting locking lugs 30—30′ projecting in opposite directions from the end passageway sections 28*b*—28*b*′ of the passageway 28. Opening onto the end faces 29*c*—29*c*′ of the mounting base 4B are vertical slots 33—33′. Also opening onto the end faces 29*c*—29*c*′ are slots 37—37′ which extend only part way down from the upper face 29*b* of the mounting base. Located between the slot pairs 33—37 and 33′—37′ are upstanding fingers 32—32′. Resiliently wedged within the pairs of slots 33—37 and 33′—37′ are the wire-like terminals 4C—4C′.

Figure 2:
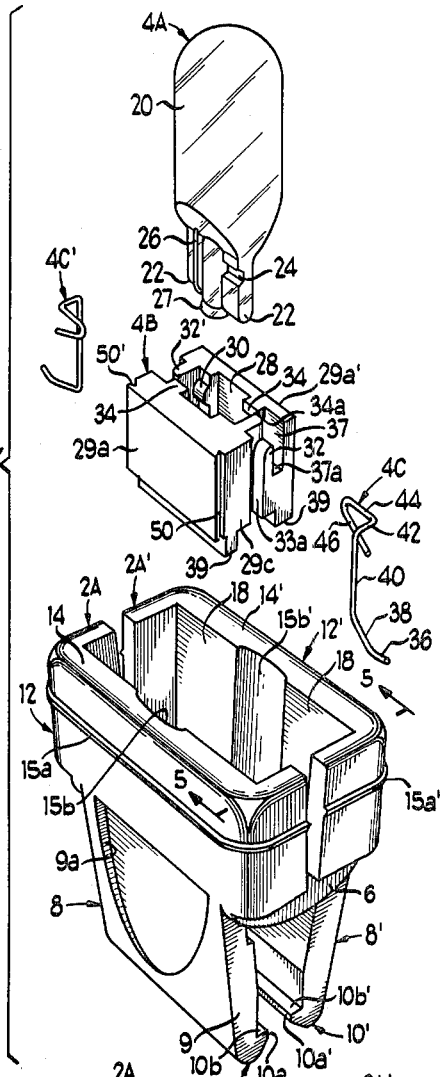
FIG. 2 is an exploded view of the basic elements making up the fuse puller device and indicator unit assembly shown in FIG. 1.
Figure 13:
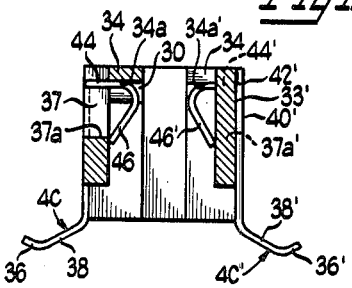
FIG. 13 is a sectional view through the mounting base shown in FIG. 12, taken along section lines 13—13 therein.
Figure 14:
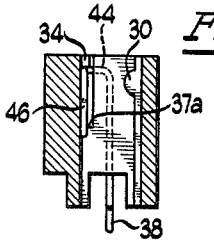
FIG. 14 is a sectional view through the mounting base shown in FIG. 12, taken along section lines 14—14 therein.

The wire-like terminals 4C—4C′, as perhaps best shown in FIGS. 2 and 13, have bottom end portions 36—36′ which make engagement with the fuse terminals T—T, inwardly inclining adjacent portions 38—38′ joining vertical portions 40—40′ which extend within the slots 33—33′. The vertical portions 40—40′ of the terminals 4C—4C′ join at the upper ends thereof laterally extending horizontal portions 42—42′ adapted to extend over the tops of the aforementioned fingers 32—32′. The horizontal portions 42—42′ of these terminals join transversely horizontally extending portions 44—44′ which underline laterally projecting ears 34—34′ of the mounting base extending into the lamp-receiving passageway 28. The horizontal portions 44—44′ of the terminals 4C—4C′ terminate in reversely downwardly inclining end portions 46—46′ which extend into the slots 37—37′ where they bear against the bottom defining walls 37*a*—37*a*′ thereof, as perhaps best shown in FIG. 13.

The wire-like terminals 4C—4C′ are loosely assembled in the mounting base by first respectively inserting the same into the slots 33—33′ and 37—37′ so that the various portions thereof (except the inclining end portions 46—46′) have the position previously described and shown in the drawings. The inclining end portions 46—46′ will then rest upon the bottom walls 37*a*—37*a*′ of the slots 37—37′ unless they are forced into other positions. The terminals 4C—4C′ are then resiliently locked into position by pushing the downwardly inclining end portions 46—46′ beyond the end of the walls 37*a*—37*a*′ and then releasing the force thereon so that the ends thereof bear against the inner vertical side faces 49—49′ of the mounting base, as best shown in FIG. 13.

When the lamp 4A has been fully inserted and locked into position on the mounting base 4B, the inclined portions 46—46′ of the wire-like terminals 4C—4C′ will resiliently engage the conductive wire terminals 26—26′ of the lamp base, to electrically connect the lamp terminal with the mounting base terminals 4C—4C′.

Figure 10:
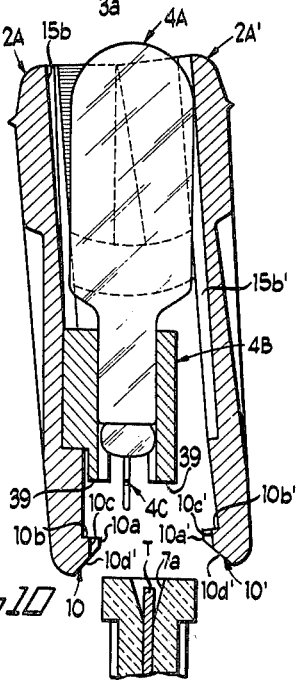
FIG. 10 is a view corresponding to FIG. 8, but showing the jaw sections thereof in their opened condition to permit release of the fuse shown in FIG. 8.
Figure 11:
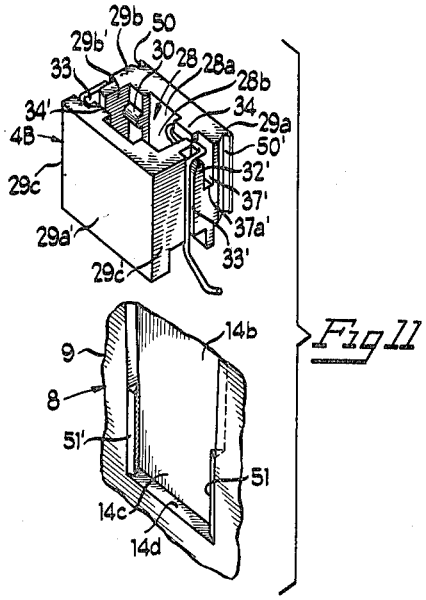
FIG. 11 is an exploded view of the lamp mounting base of the lamp indicator unit forming part of the assembly shown in FIGS. 1 through 10 and a part of the inner surface of one of the walls forming one of the jaw sections of the fuse puller device, which surface has a recess into which the lamp mounting base is friction slide fitted.
Figure 12:
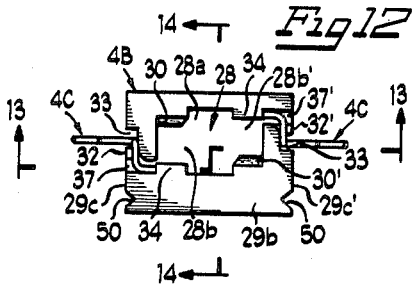
FIG. 12 is a plan view of the indicator mounting base shown in FIG. 11.

The assembly of the mounting base 4B and the lamp 4A mounted therein is supported between the confronting body portions 2A—2A′ of the fuse puller device 2, as perhaps best shown in FIGS. 8 and 10 to which reference is now made along with FIG. 11 to explain how the mounting base 4B is secured to the fuse puller device in the most preferred form of the invention illustrated. The aforementioned indicator unit-receiving cavity 18 defined between the confronting body portions 2A—2A′ of the fuse puller device is provided with lamp unit-clearance recesses 14*b*—14*b*′ respectively formed in the confronting inner faces of the fuse puller device walls 14—14′. The bottom of the recess 14*b* terminates, as best shown in FIG. 11, in a generally rectangular recess portion 14c having V-shaped confronting projections 51—51′ formed along the vertical margins thereof. The end faces 29*c*—29*c*′ of the mounting base have corresponding V-shaped grooves 50—50′ which are adapted to make a friction fitting engagement with the V-shaped projections 51—51′. To insure a permanent connection between the mounting base and the defining walls of the recess portion 14*c* an adhesive material may be placed on the confronting faces of the engaging surfaces involved. The bottom of the vertical face 29*a* of the mounting base terminates in a downwardly facing horizontally extending shoulder 29*d* which bears against the bottom 14*d* of the recess portion 14*c*, as perhaps best shown in FIGS. 8 and 10.

Figure 7:
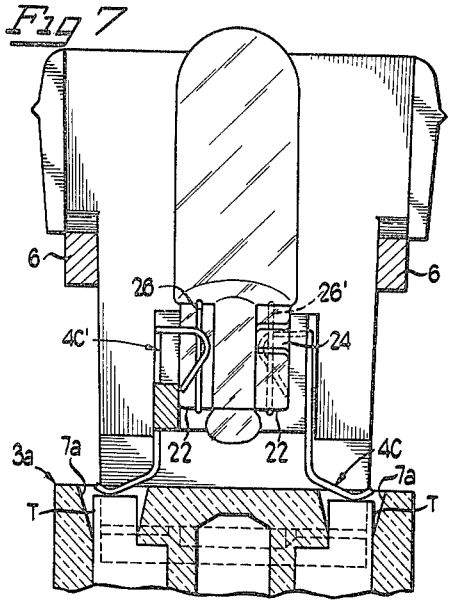
FIG. 7 is a vertical sectional view through the assembly shown in FIG. 6, taken along section lines 7—7 therein.

The lip-forming projections 10—10′ of the fuse puller device located at the bottom of the jaw sections 8—8′ have confronting upwardly and inwardly inclining camming portions 10*d*—10*d*′ which initially engage the upper edges of the head portions 7 of the fuse, as best shown in FIG. 4, when the fuse puller device is initially pressed down upon the head portion of that device. The inclined portions 10d—10d' will cam the jaw sections apart to enable the lip-forming projections to snap in place around the bottom of the head portion 7 of the fuse housing 3a as the user pushes the jaw sections over the head portion 7 of the fuse housing 3a to limit the downward movement of the fuse puller device upon the fuse housing when the lip-forming projections 10—10' are moved slightly below the head portion 7 of the fuse housing and to stabilize the storage position of the fuse puller device, the bottom faces 39—39 of the indicator unit mounting base form stop shoulders which will abut the top face of the fuse housing when the lip-forming projections are in such a lowered position. As previously indicated, any small off-centering of the fuse puller device will be corrected by the camming action of the inclined end portions 13a—13a and 13a'—13a' of the lip edge recesses 10c—10c' of the fuse puller device. The centered positions of the fuse puller device automatically positions the bottom ends 36—36' of the indicator unit terminals 4C—4C' against the fuse continuity test terminals T—T exposed through apertures in the top face of the fuse housing 3a, as best shown in FIG. 7. If the user lamp 4A is then energized by the voltage in the power circuit involved, this indicates a blown fuse, since only a discontinuity in the fuse would permit current to flow through the lamp 4A. When the user grasps the fuse puller device by placing the first segment of his thumb and forefinger into the finger-receiving recesses 9a—9a' on the outer faces of the jaw sections 8—8, as previously indicated, any finger pressure applied at that time where the fingers are in the positions as shown in FIG. 15 will apply the pressure below the pivot axis of the confronting portions of the fuse puller device to tighten the grasp of the fuse puller on the fuse. As the user pulls the fuse puller device upwardly, while gripping the fuse puller device in this manner, the fuse will be readily pulled from the pressure clip terminals involved. However, if upon applying the fuse puller device in a centered position around the fuse involved the indicator lamp 4A is de-energized, indicating that the indicator lamp is short circuited by the continuity of the fuse involved, the user pivots his fingers into the position shown in FIG. 16, where the pressure of the first segment of the thumb and forefinger would be applied primarily against the ribs 15a—15a' of the finger squeezable sections 12—12' of the fuse puller device which applies finger pressure at points above the pivot axis of the fuse puller device, so that the squeezing force will now separate the jaw sections 8—8' to enable the fuse puller device to be removed from the fuse, as shown in FIG. 16.

It is apparent from the description of the preferred form of the invention just described that it is an extremely convenient and easy to use combination fuse puller device and fuse condition indicator unit assembly. Also, this construction enables the assembly to be manufactured at a low manufacturing cost. However, it should be understood that numerous modifications may be made in this most preferred form of the invention shown in the drawings and just described without deviating from the broader aspects of the invention.

In the claims to follow, reference to the fuse puller device has been made with an assumed orientation as shown in the drawings where the jaw sections of the device are located in the lower portion thereof and the finger-squeezable sections are located in the upper portion of the device. However, it is apparent that the fuse puller device can have any orientation, since, for example the fuse could be mounted in a fuse block facing horizontally, where the fuse puller device would be oriented at right angles to the position shown in the drawings. Thus, a reference to a particular orientation of the fuse puller device in the claims is for convenience only.

We claim:

1. A fuse puller device to be inserted over and behind the head portion of a fuse housing, which head portion overhangs a lower housing portion from which depend spaced confronting terminals configured for insertion into pressure clip terminals in a mounting block or the like, said housing head portion having exposed at the top thereof a pair of fuse continuity test terminals, said fuse puller device comprising a pair of spaced confronting body portions having confronting lower fuse housing-gripping jaw section means terminating at the bottom ends thereof in horizontally inwardly facing lips for underlying said fuse housing head portion so that an upward pulling force applied to the fuse puller will remove the fuse from said pressure clip terminals, said lower jaw sections respectively joining upper confronting finger-squeezable sections of said body portions of the-fuse puller device, the confronting jaw section means and finger squeezable sections being pivotally supported by resilient pivot-forming means extending between the vertical side margins of said body portions for pivotally supporting said jaw section means and resiliently biasing them toward each other and for allowing a separation movement therebetween when said finger squeezable sections are squeezed, said body portions defining therebetween a fuse continuity indicator-receiving cavity opening onto the top of said fuse puller device and configured for accepting a continuity indicator unit which provides an indication of the fuse condition, said cavity being open at the bottom of said fuse puller device so that indicator terminals can contact said fuse continuity test terminals exposed on said fuse housing when the fuse puller device is applied over said fuse housing, and a continuity indicator unit mounted in said cavity, said indicator unit having a pair of downwardly facing indicator terminal means for engaging said fuse continuity test terminals, said indicator unit having means for providing a visible indication of fuse continuity between said test terminals when the fuse puller device is applied over the head portion of the fuse.

2. In a fuse puller device to be inserted over and behind the head portion of a fuse housing, which head portion overhangs the opposite sides of a lower housing portion from which depend spaced confronting terminals configured for insertion into pressure clip terminals in a mounting block or the like, said fuse puller device comprising a one-piece synthetic plastic molded unit having a pair of spaced confronting body portions respectively having confronting lower fuse housing-gripping jaw section means terminating in horizontally inwardly facing lips for underlying said fuse housing head portion so that an upward pulling force applied to the fuse puller device will remove the fuse from said pressing clip terminals, said jaw section means respectively joining upper confronting finger-squeezable sections of said body portions of the fuse puller device which effect pivoting separation of the jaw sections when squeezed between the user's thumb and forefinger, the improvement wherein there is provided extending between said confronting body portions of the fuse puller device pivot-forming means for pivoting said jaw section means and formed by downwardly bowed, semi-rigid but deformable arcuate straps extending between the vertical side margins of the confronting body portions of the fuse puller device, the squeezing of said upper squeezable sections bringing the ends of said straps closer together to effect pivoting of the jaw section means to move the lower ends of said jaw section means away from each other.

3. The fuse puller device of claim 2 wherein there is provided fuse puller device centering means for positioning said jaw sections on the head portion of said fuse housing so that said indicator terminals are properly positioned to make contact with said fuse continuity test terminals.

4. The fuse puller device of claim 2 wherein said finger squeezable upper sections of said body portions of the fuse puller overhang said lower jaw sections at the outer side extremities thereof, and said arcuate straps extend between said jaw sections immediately below said overhanging squeezable upper sections of the fuse puller device.

5. The fuse puller device of claim 1, 2 or 4 wherein the pivot points of said jaw sections are spaced no less than about 50% and no greater then about 70% of the overall length of the fuse puller device, measured from the bottom ends of said jaw sections.

6. In a fuse puller device to be inserted over and behind the head portion of a fuse housing, which head portion overhangs a lower housing portion from which depend spaced confronting terminals configured for insertion into pressure clip terminals in a mounting block or the like, said lower housing portion having immediately below said head portion laterally facing discontinuity-forming means, said housing head portion having exposed at the top thereof a pair of fuse continuity test terminals, said fuse puller device including a pair of confronting body portions having a pair of confronting fuse-gripping jaw section means terminating at their lower ends in confronting inwardly facing lips for underlying the overhanging portion of said head portion of said fuse housing, said jaw section means joining at their upper ends confronting finger squeezable sections, the improvement wherein there is provided between the confronting surfaces of said body portions means for receiving a fuse condition indicator unit having a pair of downwardly facing indicator unit terminal means for engaging said fuse continuity test terminals exposed on the head portion of a fuse housing so as to enable said indicator unit to test whether or not there is continuity between the test terminals, and wherein at least one of said confronting body portions has fuse puller device centering means for positioning said jaw sections on the head portion of said fuse housing to position said indicator unit terminal means to make contact with said fuse continuity test terminals.

7. The fuse puller device of claim 6 combined with such an indicator unit mounted on or in said receiving means between the confronting surfaces of said body portions of the fuse puller device.

8. In a fuse puller device to be configured for insertion over and behind the head portion of a fuse housing, which head portion overhangs the opposite sides of a lower housing portion from which depend spaced confronting terminals inserted into pressure clip terminals in a mounting block or the like, said lower housing portion having immediately below said head portion laterally facing discontinuity-forming means, said housing head portion having exposed on the outer side thereof a pair of fuse continuity test terminals, said fuse puller device having a pair of spaced confronting body portions respectively having confronting lower fuse-gripping jaw section means each formed by a wall terminating in horizontally inwardly facing lip-forming projection for underlying said fuse housing head portion so that an upward pulling force applied to the fuse puller will remove the fuse from said pressure clip terminals, said jaw section means respectively joining confronting finger-squeezable sections of said body portions of the fuse puller for effecting a pivoting separation of the jaw sections when squeezed between the user's thumb and forefinger, said inwardly facing lip-forming projections in the absence of any finger pressure applied to the device being spaced apart a distance such that said engaging surfaces underlie said head portion of the fuse housing, at least one of said lip-forming projections having a discontinuity-forming means of configuration complementary to said discontinuity-forming means of said head portion of said fuse housing and disposed so that when the fuse puller device is properly centered with respect to said fuse housing said discontinuity-forming means will snap into interfitting relationship, the improvement wherein there is provided between the confronting surfaces of said body portions means for receiving a fuse condition indicator unit having a pair of downwardly facing indicator terminals configured to engage said fuse continuity test terminals exposed on the head portion of a fuse housing so as to test whether or not there is continuity between the test terminals when the fuse puller device is applied over the head portion of the fuse.

9. The fuse puller device of claim 8 combined with said indicator unit mounted between the confronting body portions of the fuse puller device.

10. The fuse puller device or construction of claim 8 wherein said discontinuity-forming means in at least one of said lip-forming projections is a recess configured to envelop a projecting portion on said fuse housing.

11. The fuse puller device of claim 2 or 8 wherein said confronting jaw section means and finger-squeezable sections of the fuse puller device are of a length such that the first segments of a user's depending thumb and forefinger can overlie both the said finger squeezable and jaw sections of the fuse puller device as the device is gripped thereby, with the outer ends of said finger segments overlying said jaw section means below the pivot axis thereof, said jaw section means when said upper finger-squeezable sections of the fuse puller device are unstressed being spaced apart a sufficient distance to enable the lips at the ends thereof to underlie said overhanging head portion of said fuse housing, the jaw section means and the finger-squeezable body portions of the fuse puller being separable by an outward pivoting apart of the ends of the thumb and forefinger gripping the fuse puller device so that finger pressure is applied to said finger squeezable sections above said pivot axis.

12. The fuse puller device of claim 1, 2 or 8 wherein the laterally outwardly facing sides of said confronting jaw section means have finger-receiving recesses below the pivot axis of said jaw section means configured to convenient placement of the fleshy parts of the first segment of the user's thumb and forefinger into these recesses to apply a gripping pressure below said pivot axis, so that to open the jaw section means of the fuse puller device the user can pivot apart the ends of said thumb and forefinger, to bring finger pressure on the finger squeezable sections of the fuse puller device when it is desired to open the jaw sections of the fuse puller.

13. The combination fuse puller device and indicator unit of claims 1, 6 or 9 wherein said indicator unit includes a mounting base and a lamp unit removably mounted therein, said lamp base being secured within a recess formed on the inner face of one of the jaw sections of the fuse puller device.

14. The fuse puller device or combination of claim 8, 9 or 10 wherein said discontinuity-forming means on at least one of said lip-forming projections includes cam-forming centering means for automatically centering a slightly off-centered fuse pulling device.

15. The fuse puller device or combination of claim 8, 9 or 10 wherein said discontinuity-forming means on at least one of said lip-forming projections includes cam-forming centering means for automatically centering a slightly off-centered fuse puller device, said discontinuity-forming means on at least one of said lip-forming forming projections being a recess configured to envelop a projecting portion of said fuse housing, and said cam-forming means including inclined end portions of said recess.

16. The fuse puller device of claim 1, 2 or 8 wherein the laterally outwardly facing sides of said confronting jaw section means have finger-receiving recesses below the pivot axis of said jaw sections, said recesses being configured for convenient placement of the fleshy parts of the first segment of the user's thumb and forefinger into these recesses to apply a gripping pressure below said pivot axis, so that to open the jaw section means of the fuse puller device the user can pivot apart the ends of said thumb and forefinger, to increase the spacing between the ends of these fingers, to bring finger pressure on the finger squeezable sections of the fuse puller device when it is desired to open the jaw section means of the fuse puller, and said finger squeezable sections have outwardly projection ribs for pivoting thereagainst by the thumb and forefinger when said finger pressure is applied to said squeezable sections of the fuse puller to separate ends of the jaw sections.

17. The fuse puller device of claims 1, 2, 5 or 8 wherein there is provided stop shoulder means for limiting the downward movement of the fuse puller device much below the point where the lips or lip-forming projections thereof pass beyond the head portion of the fuse housing.

18. The fuse puller device of claim 7 or 9 wherein there is provided stop shoulder means for limiting the downward movement of the fuse puller device much below the point where the lips or lip-forming projections thereof pass beyond the head portion of the fuse housing, said stop shoulder means being formed by bottom portions of said indicator unit.

19. The fuse puller device of claim 1, 2, or 8, combined with said indicator unit carried by one of said jaw sections.

20. In a fuse puller device to be inserted over and behind the head portion of a fuse housing, which head portion overhangs a lower housing portion from which depend spaced confronting terminals configured for insertion into pressure clip terminals in a mounting block or the like, said lower housing portion having immediately below said head portion laterally facing discontinuity-forming means, said housing head portion having exposed at the top thereof a pair of fuse continuity test terminals, said fuse puller device including a pair of confronting body portions having a pair of confronting fuse-gripping jaw section means terminating at their lower ends in confronting inwardly facing lips for underlying the overhanging portion of said head portion of said fuse housing, said jaw section means joining at their upper ends confronting finger squeezable sections, the improvement wherein there is carried by one of said jaw section means a fuse condition indicator having a pair of downwardly facing indicator terminal means for engaging said fuse continuity test terminals exposed on the head portion over said fuse housing when said jaw section lips underlie said head portion of said fuse housing.

* * * * *